US009585537B2

(12) United States Patent
Kim

(10) Patent No.: US 9,585,537 B2
(45) Date of Patent: Mar. 7, 2017

(54) DISHWASHER

(71) Applicant: Dae Gyu Kim, Busan (KR)

(72) Inventor: Dae Gyu Kim, Busan (KR)

( * ) Notice: Subject to any disclaimer, the term of this patent is extended or adjusted under 35 U.S.C. 154(b) by 0 days.

(21) Appl. No.: 14/390,167

(22) PCT Filed: Feb. 28, 2013

(86) PCT No.: PCT/KR2013/001653
§ 371 (c)(1),
(2) Date: Oct. 2, 2014

(87) PCT Pub. No.: WO2013/151238
PCT Pub. Date: Oct. 10, 2013

(65) Prior Publication Data

US 2015/0053243 A1 Feb. 26, 2015

(30) Foreign Application Priority Data

Apr. 5, 2012 (KR) ..... 10-2012-0035645

(51) Int. Cl.
*A47L 15/30* (2006.01)
*A47L 15/42* (2006.01)
*A47L 15/50* (2006.01)

(52) U.S. Cl.
CPC ..... *A47L 15/30* (2013.01); *A47L 15/4219* (2013.01); *A47L 15/4278* (2013.01); *A47L 15/50* (2013.01)

(58) Field of Classification Search
CPC .. A47L 15/30; A47L 15/4278; A47L 15/4219; A47L 15/50
See application file for complete search history.

(56) References Cited

U.S. PATENT DOCUMENTS 1,444,902 A * 2/1923 Callahan ..... A47L 15/30 134/143
1,695,412 A * 12/1928 Cotterill ..... A47L 15/32 134/103.2
1,908,617 A * 5/1933 Rodewald ..... A47L 15/23 134/179
1,947,665 A * 2/1934 Tafel, Jr. ..... A47L 15/4225 134/115 R (Continued)

FOREIGN PATENT DOCUMENTS

CN 2234756 9/1996
CN 101904729 12/2010

(Continued)

OTHER PUBLICATIONS

Machine Translation of KR 2019970037465 to Son, Jul. 1999.*

*Primary Examiner* — Michael Barr
*Assistant Examiner* — Benjamin L Osterhout
(74) *Attorney, Agent, or Firm* — STIP Law Group, LLC

(57) ABSTRACT

The present invention relates to a dishwasher which comprises: a washer main body in which a washing basin is provided to form a space in which dishes are washed; multiple fixed jet nozzles which are fixed to the inner wall of the washing basin and jet water for washing toward the dishes at a fixed position; and a horizontally arranged cylindrical rotating rack rotatably disposed in the washing bath, wherein the inner space thereof is split into multiple dish mounting portions where the dishes can be mounted and the rotating rack rotates along the periphery of the multiple fixed jet nozzles.

11 Claims, 6 Drawing Sheets

(56) References Cited

U.S. PATENT DOCUMENTS 1,979,504 A * 11/1934 Tafel, Jr. ..... A47L 15/32 134/139
2,035,625 A * 3/1936 Walker ..... A47L 15/501 134/176
2,039,362 A * 5/1936 Tafel, Jr. ..... A47L 15/0086 134/112
2,062,704 A * 12/1936 Forsyth, Jr. ..... A47L 15/32 134/138
2,082,285 A * 6/1937 Greer, Jr. ..... A47L 15/0065 134/141
2,151,437 A * 3/1939 Ohme ..... A47L 15/30 12/37
2,254,824 A * 9/1941 Large ..... A47L 15/16 134/104.4
3,394,718 A * 7/1968 Ake Wallgren ..... A47L 15/0089 134/148
3,645,791 A * 2/1972 Sadwith ..... A47L 15/30 134/144
3,739,791 A * 6/1973 Fry ..... A47L 15/30 134/157
3,893,843 A * 7/1975 Fry ..... A47L 15/30 134/10
4,489,455 A * 12/1984 Spendel ..... C11D 11/0017 510/306
4,489,574 A * 12/1984 Spendel ..... C11D 3/386 68/16
4,555,019 A * 11/1985 Spendel ..... C11D 11/0017 206/0.5
4,718,440 A * 1/1988 Hawker ..... A47L 15/0089 134/141
5,482,066 A * 1/1996 Krueger ..... B08B 3/022 134/111
5,687,752 A * 11/1997 Boylan ..... A47L 15/42 134/115 R
8,251,631 B1 * 8/2012 Greenburg ..... A47L 15/50 414/414
2001/0042557 A1 * 11/2001 Moh ..... A47L 15/30 134/10
2009/0120469 A1 * 5/2009 Byrne ..... A47L 15/30 134/105
2012/0312338 A1 * 12/2012 Hong ..... A47L 15/30 134/157

FOREIGN PATENT DOCUMENTS

EP 1419883 5/2004
JP 05-00754 A 1/1993
KR 2019990024977 U 7/1999
KR 1020110096607 A 8/2011

* cited by examiner

DISHWASHER

CROSS-REFERENCE TO RELATED APPLICATIONS

This is a US national phase of PCT patent Application No. PCT/KR2013/001653 having an International filing date of Feb. 28, 2013, which claims priority to Korean Patent Application No. 10-2012-0035645, filed on Apr. 5, 2012, the entireties of which are incorporated herein by reference.

FIELD OF THE INVENTION

The present invention relates to a dishwasher, and in particular to a dishwasher which makes it possible to wash dishes in such a way to rotate a horizontally arranged cylindrical rotating rack on which dishes are mounted, in a state that the rotating rack faces multiple position-fixed jet nozzles, thus improving dishwashing efficiency as compared with prior dishwashers.

BACKGROUND OF THE INVENTION

A typical dishwasher as described in Korean Patent Publication Gazette Number 2002-0077643 is characterized in that in terms of its structure and operation a fixed type dish-mounted rack onto which dishes (including containers or bowls) are mounted for washing is arranged in a washing basin, and the mounted dishes are washed while multiple rotational jet nozzles configured to spray water rotate around the fixed type dish-mounted rack.

The above-mentioned fixed type dish-mounted rack may be a fixed type quadrangle rack or a rack mounted on a turntable which rotates leftward or rightward.

As described above, the prior dishwasher wherein the fixed type dish-mounted rack is fixed and dishes are washed while rotational jet nozzles rotate, has the following problems.

First, a space applicability is bad because the arrangement of dishes is limited due to the structural limitation in the fixed type dish-mounted rack, as a result of which a bulky space is required for washing.

Second, it needs to mount the dishes onto the fixed type dish-mounted rack in a state that a concave side of each of the dishes is positioned to face downward in order to let washing or rinsing water to trickle down well, which makes the use of the dishwasher complicated.

Third, it may take relatively longer time to wash dishes because of the structure that the dishes are washed while rotational jet nozzles rotate around the fixed type dish-mounted rack.

Fourth, there may be a difference in washing force varying based on the positions or shapes of the mounted dishes, thus partially leaving unwashed food residues behind even after washing.

Fifth, it needs to additionally install an opening and closing door at a front side or a lateral side due to its structure, so mounting or unmounting dishes causes inconvenience when in use along with complicated mechanical structures.

Sixth, mold may grow due to incomplete dry in the dishwasher, so hygiene problems occur.

As listed above, in the prior dishwasher, a variety of problems occur due to the structural limitations, more specifically, due to the limited structure that a fixed type dish-mounted rack is fixed in the washing basin, and the rotational jet nozzles are configured to rotate. In order to improve the above-listed problems, it is urgent to develop a new dishwasher.

DETAILED DESCRIPTION OF THE INVENTION

Technical Field

Figure 1:
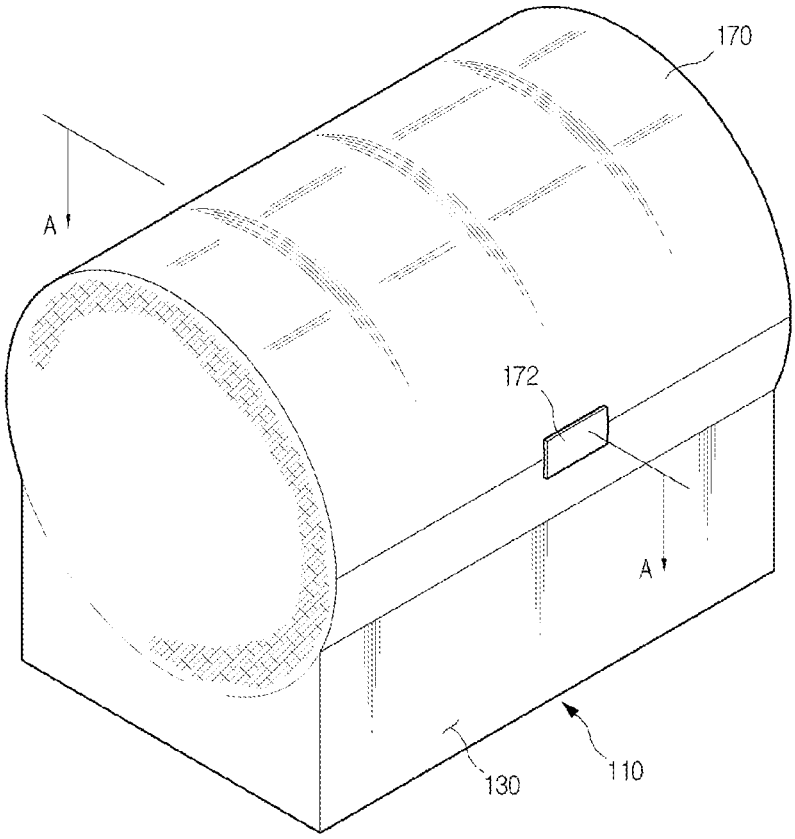
FIG. 1 is a schematic perspective view illustrating a dishwasher according to an exemplary embodiment of the present invention.

Accordingly, It is an object of the present invention to provide a dishwasher which makes it possible to improve washing efficiency.

Technical Solution

To achieve the above object, there is provided a dishwasher, comprising a washer main body which includes a washing basin disposed inside of the washer main body wherein the washing basin provides a predetermined space in which to wash dishes; multiple fixed jet nozzles at an inner wall of the washing basin and are configured to spray washing water from fixed positions toward the dishes; and a horizontally arranged cylindrical rotating rack which is rotatably arranged inside of the washing basin and whose inside space is splited into multiple dish mounting portions configured to mount the dishes and which rotates along the periphery of the multiple fixed jet nozzles.

The horizontally arranged cylindrical rotating rack is formed in a net mesh structure made from a high elasticity wire material made from stainless steel wire or high molecular compound.

The shapes or volumes of the multiple dish mounting portions are different, and the multiple dish mounting portions are arranged in a radial shape about the central axis of the rotation of the horizontally arranged cylindrical rotating rack.

There is further provided a rack rotation driving unit which is disposed outside of the washing basin and is configured to continuously rotate 360° the horizontally arranged cylindrical rotating rack.

The fixed jet nozzles are arranged along multiple imaginary lines formed in a direction crossing the longitudinal direction of the washing basin, and the multiple imaginary lines comprise a first line along which the fixed jet nozzles are arranged to spray water in a direction crossing the direction of gravity; and a second line which is arrange in close proximity to the first line and along which the fixed jet nozzles are arranged so as to spray water in a direction being opposed to the direction of gravity.

The first line and the second each are provided in multiple numbers and are arranged alternating with each other.

The fixed jet nozzles are formed sunk at the inner wall of the washing basin.

There is further provided a water storage basin which is disposed at a lower side of the washing basin, and at a boundary surface between the washing basin and the water storage basin, a drainage passage including a filtering mesh configured to filter food residue is provided.

There are further provided a pump which serves to recycle the water of the water storage basin; a first circulation pipe which interconnects the water storage basin and the pump; and a second circulation pipe which interconnects the pump and the jet nozzles of the washing basin.

Advantageous Effects

According to the present invention, it is possible to prevent any washing problems and improve washing efficiency in such a way to rotate a cylindrical rotating rack facing multiple position-fixed jet nozzles wherein the dish-mounted cylindrical rotating rack is arranged in a horizontal direction.

MODE FOR INVENTION

The exemplary embodiments of the present invention will be described with reference to the accompanying drawings.

Figure 2:
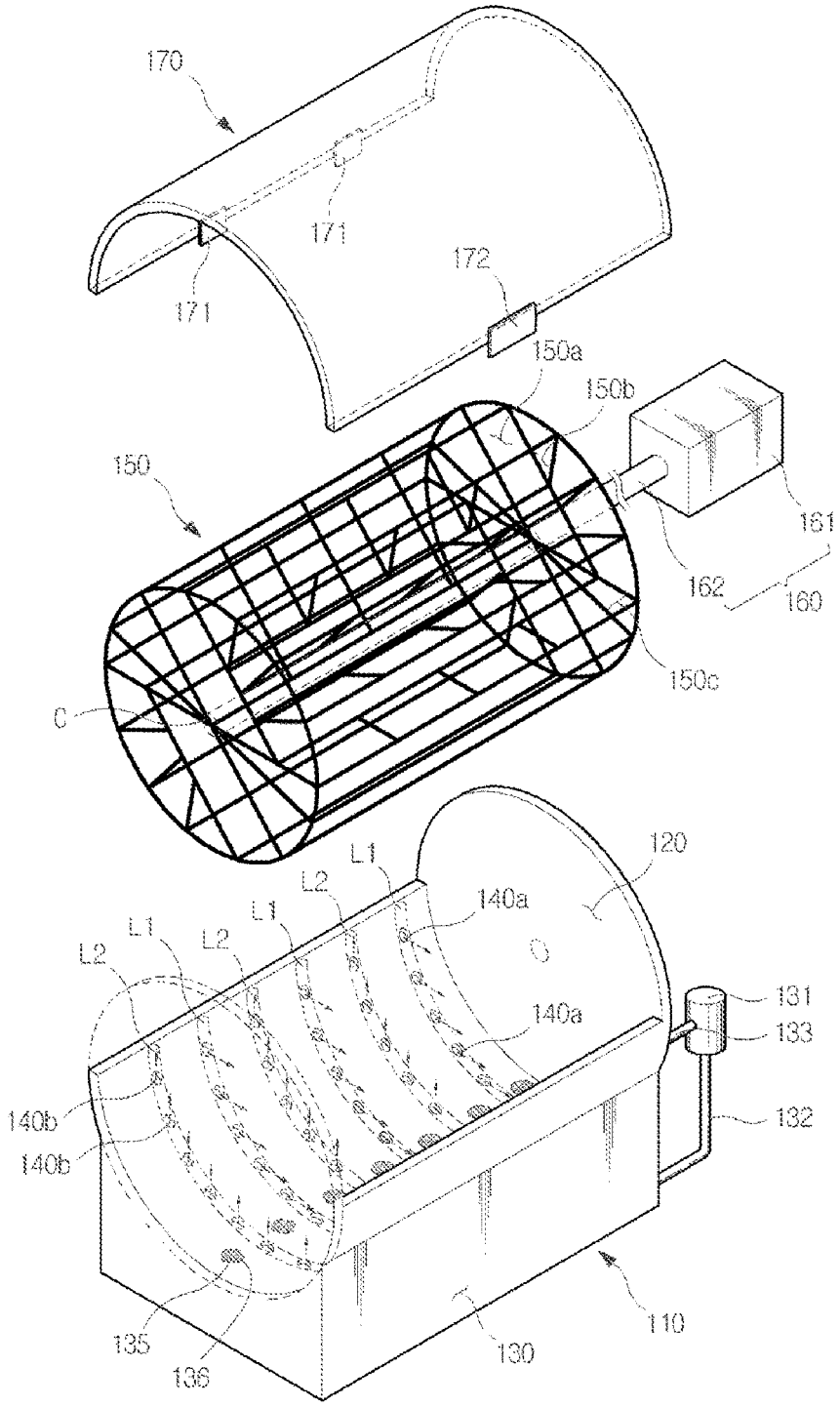
FIG. 2 is a disassembled perspective view of FIG. 1.
Figure 3:
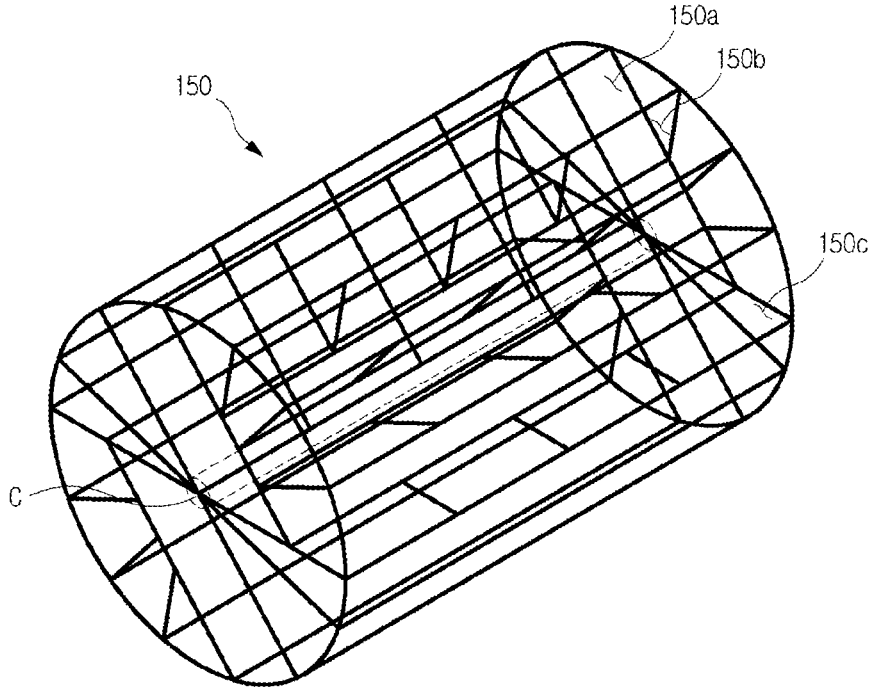
FIG. 3 is an enlarged perspective view illustrating a horizontally arranged cylindrical rotating rack.
Figure 4:
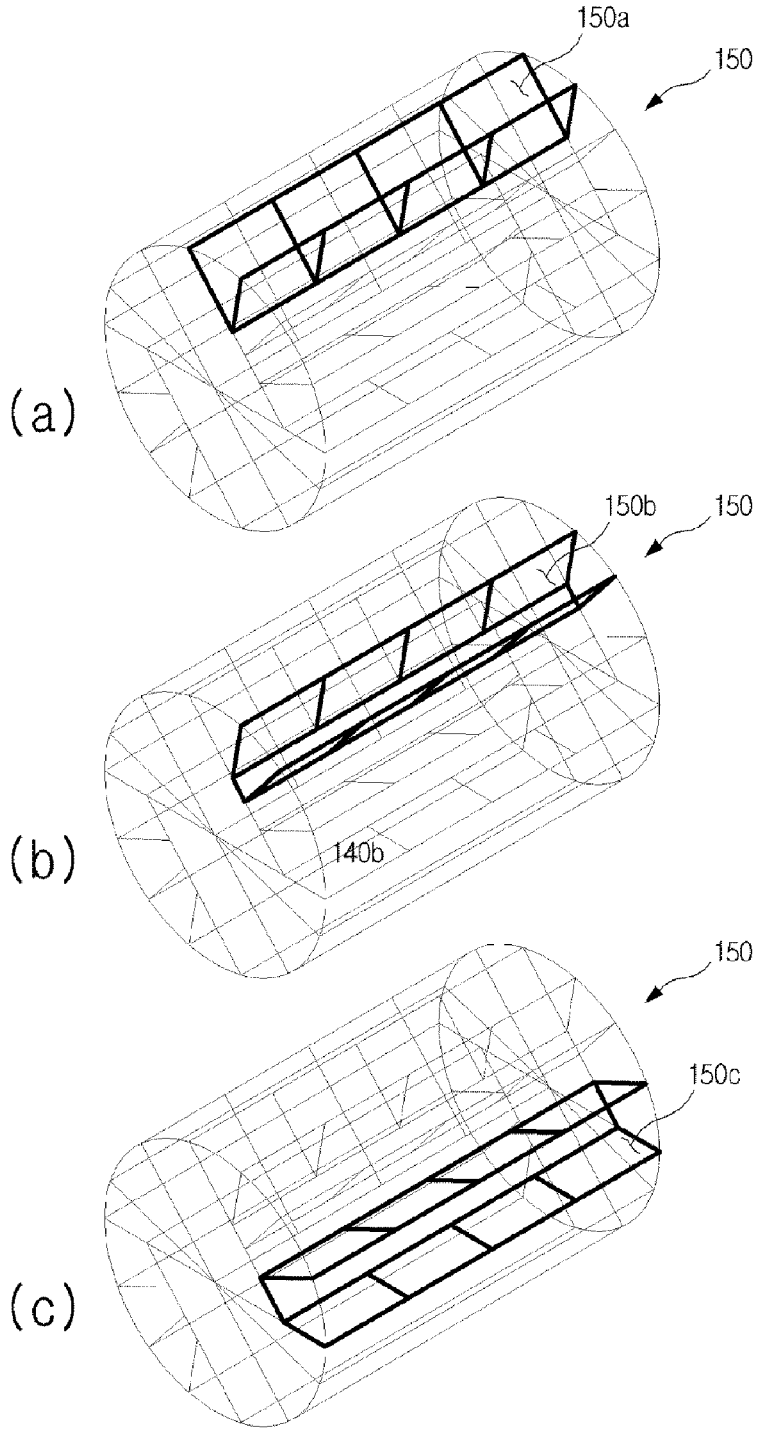
FIGS. 4A to 4C are schematic cross sectional views taken along line A-A of FIG. 1.
Figure 5:
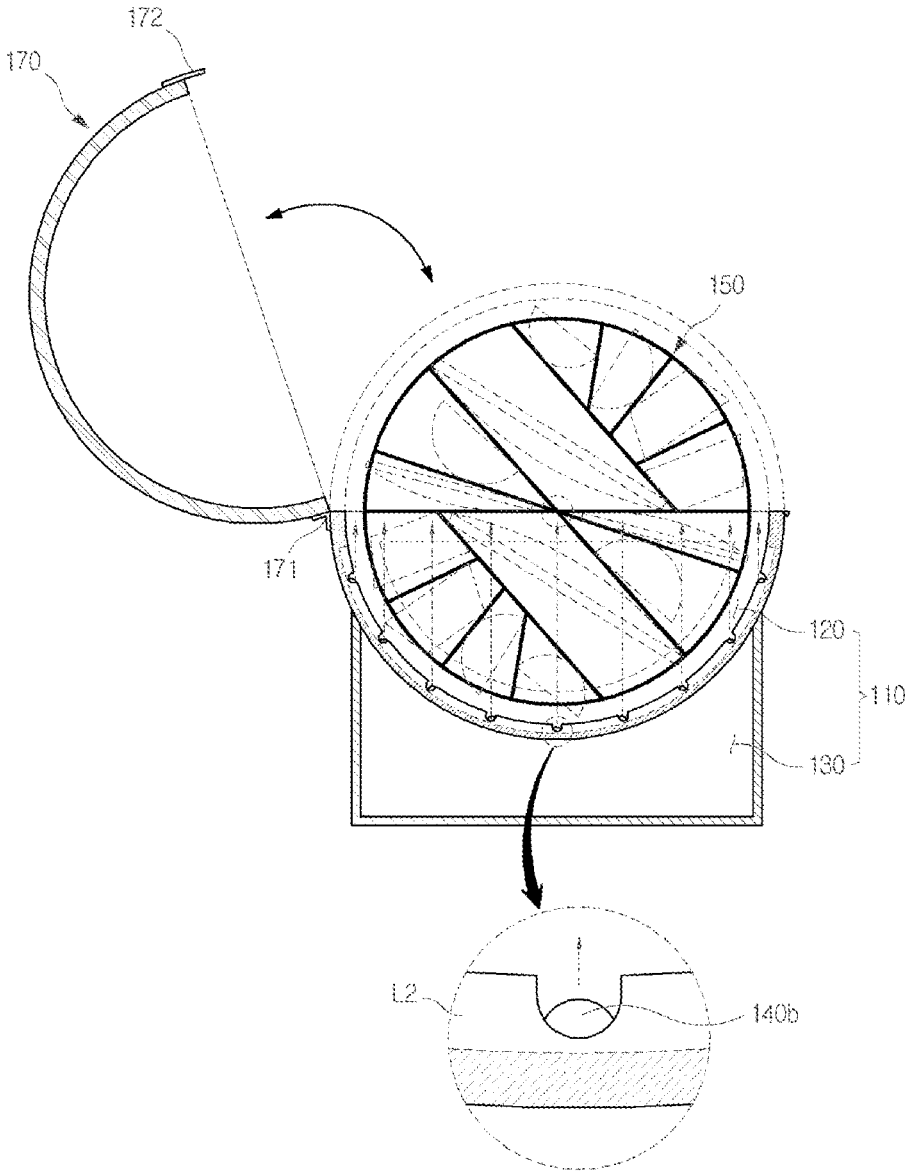
FIG. 5 is a schematic cross sectional view taken along line A-A of FIG. 1.

FIG. 1 is a schematic perspective view illustrating a dishwasher according to an exemplary embodiment of the present invention. FIG. 2 is a disassembled perspective view of FIG. 1. FIG. 3 is an enlarged perspective view illustrating a horizontally arranged cylindrical rotating rack. FIGS. 4A to 4C are schematic cross sectional views taken along line A-A of FIG. 1. In addition, FIG. 5 is a schematic cross sectional view taken along line A-A of FIG. 1.

As illustrated therein, the dishwasher according to an exemplary embodiment of the present invention comprises a washer main body 110 including a washing basin 120 and a water storage basin 130 both disposed inside of the washer main body 110, multiple fixed jet nozzles 140*a* and 140*b* all fixed at an inner wall of the washing basin 120, a horizontally arranged cylindrical rotating rack 150 which forms a predetermined space in which dishes (including containers or bowls) are mounted, and is rotatably arranged inside of the washing basin 120, and a cover 170 configured to open or close an upper opening of the washing basin 120.

The washer main body 110 forms along with the cover 170 the exterior of the dishwasher according to an exemplary embodiment of the present invention. In the drawings, there is illustrated a construction that a cylindrical structure, more specifically, the washer main body 110, is mounted on a box-shaped structure. Such a structure is disclosed according to an exemplary embodiment of the present invention, not limiting the scope of the present invention.

To the washer main body 110, a detergent input device, a cold or hot water supply device, a hot water heating device, a drainage device, a food residue removing device, etc. may be connected. These devices and their connections will be omitted from descriptions for simplification.

Inside of the washer main body 110, there are provided a washing basin 120 and a water storage basin 130.

The washing basin 120 is positioned at a portion higher than the water storage basin 130. The washing basin 120 forms a predetermined space in which dishes are washed. The water storage basin 130 is configured to collect the water and detergent which have been already used for washing.

The washing basin 120 will be first described. The washing basin 120 is made in such a way that a laid hollow, cylindrical structure is cut along its horizontal, central axis leaving its lateral side uncut, and top of the structure is removed, thus forming the washing basin 120 whose top is open.

More specifically, the washing basin 120 surrounds more than half of the lower side of the central axis of the horizontally arranged cylindrical rotating rack 150, by means of which it is possible to prevent the mounted dishes from getting away.

The washing basin 120 may be made from a stainless steel or a high molecular compound. If the washing basin 120 is made from such a material, it becomes resistive to bacteria. The washing basin 120 may be disposed inside of the washer main body 110.

Multiple fixed jet nozzles 140*a* and 140*b* are engaged to the inner wall of the washing basin 120. Different from the related jet nozzles, the fixed jet nozzles 140*a* and 140*b* of the present invention are fixed at the inner wall of the washing basin 120. As compared with the related rotatable jet nozzles, the fixed jet nozzles 140*a* and 140*b* of the present invention are fixed in place, thus spraying washing water (including detergent) from the fixed positions toward the dishes.

Here, the fixed jet nozzles 140*a* and 140*b* are formed sunk at the inner wall of the washing basin 120. When the horizontally arranged cylindrical rotating rack 150 on which the dishes are mounted rotates in the washing basin 120, the dishes don't interfere with the fixed jet nozzles 140*a* and 140*b*.

The fixed jet nozzles 140*a* and 140*b* may be provided in multiple numbers at the inner wall of the washing basin 120. Multiple the fixed jet nozzles 140*a* and 140*b* are arranged along multiple imaginary lines L1 and L2 which are formed crossing the longitudinal direction of the washing basin 120. Referring to FIG. 2, multiple the imaginary lines L1 and L2 are indicated by dotted line. Such imaginary lines L1 and L2 may be imaginary or otherwise such imaginary lines may indicate embedded pipes interconnecting the fixed jet nozzles 140*a* and 140*b*.

Referring to FIG. 2, the multiple lines L1 and L2 comprise a first line L1 along which the fixed jet nozzles 140*a* are disposed so as to spray water in the direction crossing the direction of gravity, and a second line L2 which is disposed in proximity to the first line L1 and along which the fixed jet nozzles 140*b* are disposed so as to spry water in the direction being opposed to the direction of gravity.

In the present exemplary embodiment, each of the first line L1 and the second line L2 is provided by three in number, and they are alternately arranged, by means of which washing force may be greatly increased. The fixed jet nozzles 140*a* and 140*b* and the capacity of the pump 131 which will be described later may be determined based on an interrelationship between the washing force and the washing time.

The fixed jet nozzles 140*a* and 140*b* may be disposed in multiple numbers along multiple lines L1 and L2. Here, along the lines L1 and L2, such fixed jet nozzles 140*a* and 140*b* may be arranged at regular intervals or otherwise irregular intervals.

The water storage basin 130 is disposed in the lower area of the washing basin 120. As described earlier, the water storage basin 130 is configured to collect the water and detergent which have been used when washing dishes.

In the present exemplary embodiment of the present invention, for the sake of resource recycling, the water (including detergent) collected in the water storage basin 130 may return to the washing basin 120, thus recycling it. For this operation, as illustrated in FIG. 2, there are provided a pump 131, a first circulation pipe 132 and a second circulation pipe 133.

The pump 131 serves to pump up water so as to recycle the water in the water storage basin 130. The first circulation pipe 133 interconnects the water storage basin 130 and the pump 131. The second circulation pipe 133 interconnects the pump 131 and the fixed jet nozzles 140*a* and 140*b* disposed at the inner wall of the washing basin 120. When the pump 131 starts, the water (including detergent) in the water storage basin 130 may flow through the first circulation pipe 132 and the second circulation pipe 133 to the fixed jet nozzles 140*a* and 140*b*. Here, the water which was used a predetermined times may be discarded.

At a boundary surface between the washing basin 120 and the water storage basin 130, a drainage passage 136 including a filtering mesh 135 may be formed so as to filter food residues. As illustrated in FIG. 2, multiple the drainage passages 136 are formed in a circular shape. The drainage passage 136 may be one or multiple ditches.

The cover 170 will be described. One side of the cover 170 is engaged to the washing basin 120 with a hinge 171, thus rotatably opening and closing the opening of the top of the washing basin 120.

Since the cover 170 is provided on top of the washing basin 120, the horizontally arranged cylindrical rotating rack 150 may be inputted or removed after opening the top of the washing basin 120, so the mounting or unmounting of the dishes becomes much easier as compared to the related dishwasher.

The cover 170 may be made from a visible or semi-visible material to see the inside of the dishwasher through the cover; however it is not limited thereto. Alternatively, a locker 172 may be disposed at the opposite side of the hinge 171.

In order to prevent any leakage between the washing basin 120 and the cover 170 during washing, not illustrated in the drawings, a packing may be disposed between the washing basin 120 and the cover 170.

In the drawings, the cover 170 is schematically illustrated; however if a cover rotating member and a controller are further provided, the cover 170 may be set to be automatically closed after washing. In addition, a sensor, a controller, etc. may be further provided for the sake of safety during a series of washing operations.

The horizontally arranged cylindrical rotating rack 150 is rotatably arranged in a horizontal direction in the washing basin 120, more specifically, the central axis of the rotation of the horizontally arranged cylindrical rotating rack 150 is rotatably arranged in a horizontal direction at the washing basin 120. The horizontally arranged cylindrical rotating rack 150 rotates around the multiple fixed jet nozzles 140*a* and 140*b*. The horizontally arranged cylindrical rotating rack 150 is manufactured in a net mesh structure, and the inside space of the horizontally arranged cylindrical rotating rack 150 is splited into multiple dish mounting portions 150*a*, 150*b*, 150*c*, . . . onto which the dishes are mounted.

In case of the present exemplary embodiment of the present invention, the dishes are washed while the horizontally arranged cylindrical rotating rack 150 on which the dishes are mounted rotate facing the jet nozzles 140 which are fixed in place, thus enhancing washing efficiency as compared with the related dishwasher. The dishwasher according to the present invention is capable of cleanly washing dishes without causing any problems during washing while overcoming a variety of problems which are caused by means of the related dishwasher.

The horizontally arranged cylindrical rotating rack 150 is made from a high elasticity wire material of stainless steel wire or high molecular compound. In other words, the horizontally arranged cylindrical rotating rack 150 is generally formed in a net mesh structure. So, the water sprayed from the fixed jet nozzles 140 can easily contact with dishes, and on the contrary, the water used for washing such dishes can be easily drained.

The multiple dish mounting portions 150*a*, 150*b*, 150*c*, . . . of the horizontally arranged cylindrical rotating rack 150 which is manufactured in the net mesh structure as described earlier each have different shapes or volumes. They are arranged in a radial shape about the central axis of the rotation of the horizontally arranged cylindrical rotating rack 150.

FIG. 3 illustrates the horizontally arranged cylindrical rotating rack 150, which looks a little complicated, so the above-described construction will be described in more details with reference to FIGS. 4A, 4B and 4C. As illustrated in FIGS. 4A, 4B and 4C, the multiple dish mounting portions 150*a*, 150*b*, 150*c*, . . . are arranged in a radial shape about the central axis of the rotation of the horizontally arranged cylindrical rotating rack 150, with their shapes or volumes being different. As illustrated in FIG. 5, it is easily to easily and conveniently mount the dishes irrespective of the kinds of dishes such as bowls, containers, plates, table wares, etc. or irrespective of the sizes of them, which improves the applicability of space, thus greatly reducing the entire volume of the dishwasher.

The horizontally arranged cylindrical rotating rack 150 rotates continuously 360° in the washing basin 120 by means of a rack rotation driving unit 160.

The rack rotation driving unit 160 comprises a driving motor 161, and a coupling portion 162 which is connected to a central shaft "C" of the horizontally arranged cylindrical rotating rack 150. By means of the driving motor 161 including a decelerator, the horizontally arranged cylindrical rotating rack 150 may rotate continuously 360° in the washing basin 120 or may rotate slowly, so the whole surfaces of the front and rear sides are uniformly exposed to the water and detergent both sprayed through the fixed jet nozzles 140*a* and 140*b*, while the dishes mounted on the horizontally arranged cylindrical rotating rack 150 rotate together, which leads to the reduced problems during the washing of the dishes and the enhanced washing efficiency.

An assistant net mesh (assistant rack (not shown)) may be additionally manufactured for the washing of chopsticks, spoons, forks, etc., and the assistant mesh net housing them is mounted onto the horizontally arranged cylindrical rotating rack 150, thus washing the chopsticks, spoons, forks, etc.

When the horizontally arranged cylindrical rotating rack 150 is applied to the exemplary embodiment of the present invention, the following advantages can be obtained.

First, in case of the related dishwasher wherein there are provided the fixed quadrangle rack or the rack mounted on the turntable which rotates leftward or rightward, it needs to mount the dishes with the concave side of each of the dishes facing downward, which makes complicated the work for mounting the dishes and requires a lot of time when mounting the dishes. As compared with the above-described related dishwasher, the horizontally arranged cylindrical rotating rack 150 applied to the dishwasher according to the present exemplary embodiment of the present invention is 360° rotatable, so the dishes mounted on the horizontally arranged cylindrical rotating rack 150 also rotates 360°, whereby the dishes may be washed irrespective of the mounted direction of each of the dishes, thus obtaining easier dish mounting work, which results in reduced dish mounting time.

Second, in case of the related dishwasher wherein there are provided the fixed quadrangle rack or the rack mounted on the turntable which rotates leftward or rightward, it needs to install the rack in a 2-layer structure so as to mount the dishes onto each of two layers, which causes inconvenience. As compared with the above-described related dishwasher, the horizontally arranged cylindrical rotating rack 150 is configured to mount multiple dishes onto each of multiple dish mounting portions 150*a*, 150*b*, 150*c*, . . . arranged along the horizontal direction after they are sorted based on the sizes of the dishes, thus greatly enhancing space applicability.

Third, in case of the related dishwasher wherein there are provided the fixed quadrangle rack or the rack mounted on the turntable which rotates leftward or rightward, it is impossible to enable the water from the rotating jet nozzles (not shown) to reach the whole portions of the front sides of the mounted dishes. In this case, the washing dependency on the water which indirectly reaches increases, so it takes relatively longer time to wash the dishes. As compared with the above-described related dishwasher, the present exemplary embodiment of the present invention is characterized in that while the horizontally arranged cylindrical rotating rack 150 slowly rotate 360°, the whole portions of the front and rear side of each of the mounted dishes are directly exposed to the water from the fixed jet nozzles 140*a* and 140*b* installed at the inner wall of the washing basin 120, thus greatly reducing washing time. In case that a predetermined substance such as starch, etc. which does not easily undergo chemical decomposition is got on the dishes, washing time may be reduced because such a substance is directly exposed to relatively stronger water spray force with high momentum, thus obtaining high washing efficiency.

The operations of the thusly constituted dishwasher will be described.

The dishes are mounted onto the multiple dish mounting portions 150*a*, 150*b*, 150*c*, . . . of the horizontally arranged cylindrical rotating rack 150, and the cover 170 is opened, and the horizontally arranged cylindrical rotating rack 150 is arranged in the washing basin 120.

Next, the horizontally arranged cylindrical rotating rack 150 is slowly rotated 360° by the rack rotation driving unit 160, and the pump 131 is also driven.

In a state that the dishes are fixed in place, the dishes are washed by the water from the fixed jet nozzles 140*a* and 140*b* which are configured to spray water at different angles while the horizontally arranged cylindrical rotating rack 150 rotates slowly, thus enhancing dish washing efficiency.

According to the present exemplary embodiment of the present invention, since the dishes are washed by the water from the jet nozzles 140*a* and 140*b* fixed in place, while the horizontally arranged cylindrical rotating rack 150 on which the dishes are mounted rotates, dish washing efficiency may be enhanced as compared with the related dishwasher. So, it is possible to wash the dishes cleanly without any problems during washing while overcoming some other problems which are found in the related dishwasher.

In case of the dishwasher according to the present exemplary embodiment of the present invention, space applicability may be enhanced for thereby reducing the volume of the dishwasher.

Since the horizontally arranged cylindrical rotating rack 150 continuously rotates 360°, the dishes may be freely mounted without considering their upper sides or lower sides, which leads to good convenience when in use, and the front side, rear side and lateral side of each of the dishes may be intensively washed by the water from the fixed jet nozzles 140*a* and 140*b* for thereby reducing washing time while saving energy.

Since the cover 170 and the opening are formed on top, it is easy and convenient to mount or unmount the dishes. When the cover 170 is opened and remains open, the inside of the dishwasher may be naturally dried, so the growing environment of fungi cannot be formed inside of the dishwasher, thus overcoming hygiene problem.

Figure 6:
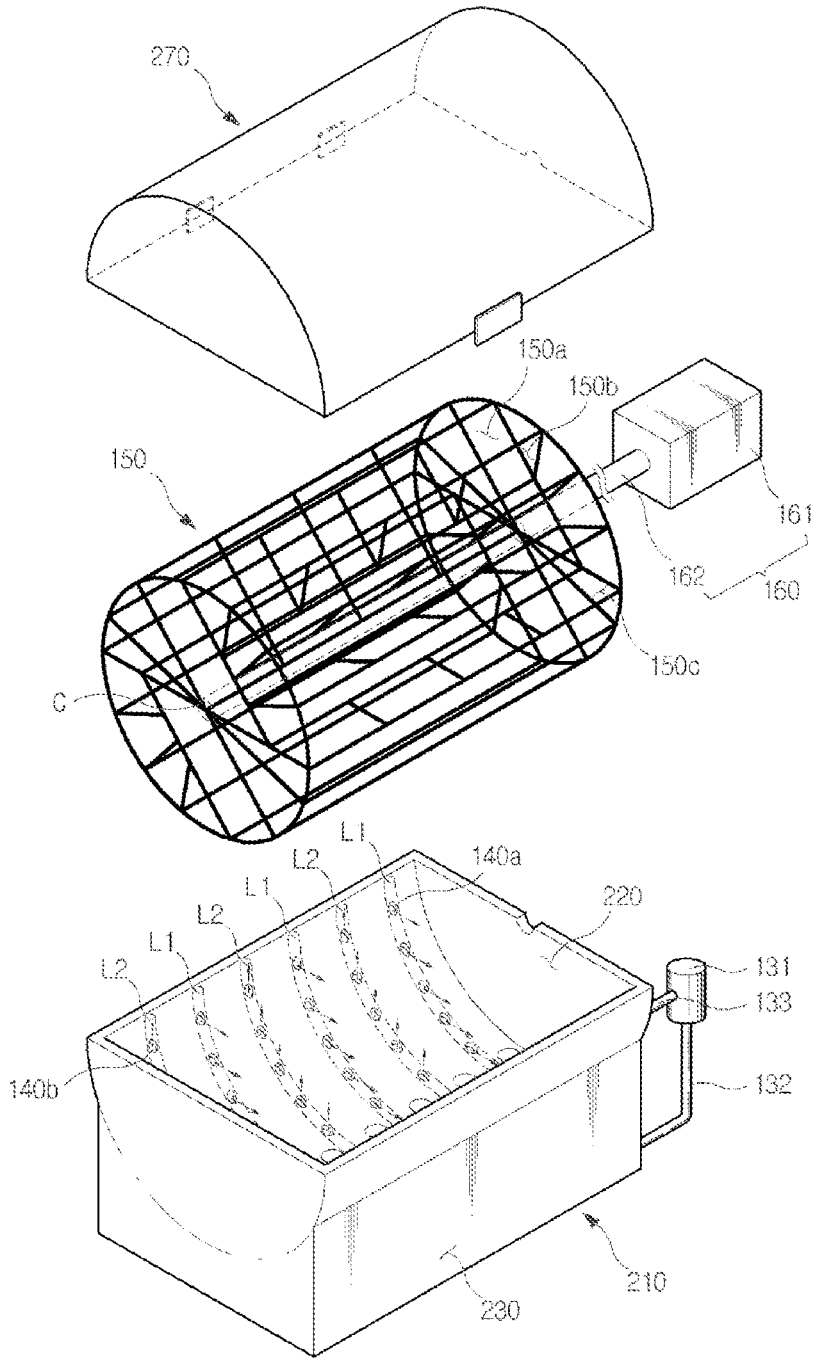
FIG. 6 is a disassembled perspective view illustrating a dishwasher according to another exemplary embodiment of the present invention.

FIG. 6 is a disassembled perspective view illustrating a dishwasher according to another exemplary embodiment of the present invention.

In this exemplary embodiment, different from the construction of FIG. 2, there is a little difference between the shape of the washer main body 210 in which the washing basin 220 and the water storage basin 230 are disposed and the shape of the cover 270.

The washing basin 220 and the cover 270 are manufacturing by bisecting a circular cylinder along its longitudinal direction. Even when such a structure is applied to the present invention, the dishes may be washed while the horizontally arranged cylindrical rotating rack 150 on which the dishes are mounted rotates facing the jet nozzles 140*a* and 140*b* which are fixed in place, thus enhancing washing efficiency of the dishes. So, it is possible to wash the dishes cleanly without causing any problems during washing. A variety of problems encountered in the related dishwasher may be resolved by the present invention.

The above-described exemplary embodiments of the present invention are provided for illustrative purposes and should understood in such a way that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

* Legend of Reference Numbers *

| | |
|---|---|
| 110: washer main body | 120: washing basin |
| 130: water storage basin | 131: pump |
| 132: first circulation pipe | 133: second circulation pipe |
| 136: drainage passage | 140a, 140b: fixed jet nozzles |
| 150: horizontally arranged cylindrical rotating rack | 160: rack rotation driving unit |
| 170: cover | |

I claim:

1. A dishwasher, comprising:

a washer main body which includes a washing basin disposed inside of the washer main body wherein the washing basin forms a space in which to wash dishes;

multiple fixed jet nozzles at an inner wall of the washing basin and are configured to spray washing water from the fixed positions toward the dishes; and a horizontally arranged cylindrical rotating rack which is rotatably arranged inside of the washing basin and whose inside space is split into multiple dish mounting portions configured to mount the dishes and which rotates along the periphery of the multiple fixed jet nozzles, wherein the fixed jet nozzles are arranged to form multiple rows along the inner wall in a transverse direction of the washing basin, and wherein the multiple rows comprise:

a first row along which the fixed jet nozzles are arranged to spray water in a direction crossing the direction of gravity; and a second row which is arranged in close proximity to the first row and along which the fixed jet nozzles are arranged so as to spray water in a direction being opposed to the direction of gravity.

2. The dishwasher of claim 1, wherein the horizontally arranged cylindrical rotating rack is formed in a net mesh structure.

3. The dishwasher of claim 1, wherein the shapes or volumes of the multiple dish mounting portions are different from each other, and the multiple dish mounting portions are arranged in a radial shape about the central axis of the rotation of the horizontally arranged cylindrical rotating rack.

4. The dishwasher of claim 1, further comprising: a rack rotation driving unit which is disposed outside of the washing basin and is configured to make the horizontally arranged cylindrical rotating rack continuously rotates 360°.

5. The dishwasher of claim 1, wherein the first row and the second row are provided in multiple numbers and are arranged alternating with each other.

6. The dishwasher of claim 1, wherein the fixed jet nozzles are formed sunk in the inner wall of the washing basin.

7. The dishwasher of claim 1, further comprising: a water storage basin which is disposed at a lower side of the washing basin, and at a boundary surface between the washing basin and the water storage basin, a drainage passage including a filtering mesh configured to filter food residue is provided.

8. The dishwasher of claim 7, further comprising:

a pump which serves to recycle the water of the water storage basin;

a first circulation pipe which interconnects the water storage basin and the pump; and a second circulation pipe which interconnects the pump and the jet nozzles of the washing basin.

9. The dishwasher of claim 1, wherein the inner wall is curved.

10. The dishwasher of claim 1, wherein the first row and the second row are alternately arranged.

11. The dishwasher of claim 1, wherein the axis of the rotation of the cylindrical rotating rack is parallel to the transverse direction of the washing basin.

* * * * *